US009431721B2

(12) United States Patent
Wimmer et al.

(10) Patent No.: US 9,431,721 B2
(45) Date of Patent: Aug. 30, 2016

(54) CONTACT ELEMENT

(71) Applicant: Lisa Dräxlmaier GmbH, Vilsbiburg (DE)

(72) Inventors: Wolfgang Wimmer, Salching (DE); Georg Scheidhammer, Bodenkirchen (DE)

(73) Assignee: Lisa Draexlmaier GmbH, Vilsbiburg (DE)

( * ) Notice: Subject to any disclaimer, the term of this patent is extended or adjusted under 35 U.S.C. 154(b) by 0 days.

(21) Appl. No.: 14/458,568

(22) Filed: Aug. 13, 2014

(65) Prior Publication Data

US 2015/0050829 A1 Feb. 19, 2015

(30) Foreign Application Priority Data

Aug. 14, 2013 (DE) ..... 10 2013 013 458

(51) Int. Cl.
*H01R 4/24* (2006.01)
*H01R 13/11* (2006.01)
*H01R 13/02* (2006.01)

(52) U.S. Cl.
CPC ..... *H01R 4/2416* (2013.01); *H01R 4/2425* (2013.01); *H01R 13/02* (2013.01); *H01R 13/112* (2013.01)

(58) Field of Classification Search
CPC .. H01R 4/2416; H01R 4/242; H01R 4/2425; H01R 4/2429; H01R 4/2433; H01R 4/2437; H01R 4/2445; H01R 4/245; H01R 4/2454
See application file for complete search history.

(56) References Cited

U.S. PATENT DOCUMENTS 3,287,686 A 11/1966 Ruehlemann
3,412,369 A * 11/1968 Fox ..... H01R 4/14 439/748
3,588,785 A * 6/1971 Hardardt et al. ..... H01R 23/72 439/249
4,002,391 A * 1/1977 Dunn ..... H01R 4/2425 439/403
4,059,331 A * 11/1977 Sedlacek ..... H01R 9/2416 29/764
4,106,837 A * 8/1978 Paluch ..... H01R 9/16 439/403
4,156,119 A * 5/1979 Matthews ..... H01H 15/02 200/16 F
4,359,257 A * 11/1982 Lopinski ..... H01R 12/675 439/405
4,470,655 A * 9/1984 Kalka ..... H01R 4/2433 439/397

(Continued)

FOREIGN PATENT DOCUMENTS

DE 101 49 574 A1 4/2003
DE 101 52 006 A1 5/2003

(Continued)

*Primary Examiner* — Ross Gushi
(74) *Attorney, Agent, or Firm* — Finnegan, Henderson, Farabow, Garrett & Dunner LLP

(57) ABSTRACT

A contact element for creating an electrical contact between a first and a second electrical or electronic component, including a one-piece, elongated, and flat body. The body may include a first end segment, a second end segment opposite the first end segment, an insulation displacement connection site in the first end segment, and a lamellae contact with two lamellae being located at the second end segment. At least one lamella may be resilient.

20 Claims, 2 Drawing Sheets

(56) References Cited

U.S. PATENT DOCUMENTS 4,863,402 A * 9/1989 Black ..... H01R 43/24 29/883
4,897,041 A * 1/1990 Heiney ..... H01R 23/661 439/404
5,163,855 A * 11/1992 Gerke ..... H01R 12/716 439/395
5,683,268 A * 11/1997 Drach ..... H01R 4/2429 439/404
5,722,850 A * 3/1998 White ..... H01R 4/2425 439/404
5,759,061 A * 6/1998 Jensen ..... H01R 4/2416 439/400
6,068,503 A * 5/2000 Gerke ..... H04Q 1/142 439/404
6,142,817 A * 11/2000 Lee ..... H01R 13/112 439/395
6,247,974 B1 * 6/2001 Jenner ..... H01R 4/2429 439/403
6,309,240 B1 * 10/2001 Daoud ..... H01R 9/2475 439/403
6,346,005 B1 * 2/2002 Viklund ..... H01R 4/2429 439/404
6,350,144 B1 * 2/2002 Afflerbaugh ..... H01R 9/2433 439/404
6,729,899 B2 * 5/2004 Aekins ..... H01R 13/6464 439/404
6,799,988 B2 * 10/2004 Mansur ..... H01R 4/2429 439/404
6,866,536 B1 * 3/2005 Lee ..... H01R 13/112 439/387
6,866,538 B2 3/2005 Lee
6,878,004 B2 * 4/2005 Oh ..... H01H 85/2035 439/250
7,223,115 B2 * 5/2007 Hashim ..... H01R 4/245 439/403
7,270,551 B2 * 9/2007 Busse ..... H01R 29/00 439/188
7,322,847 B2 * 1/2008 Hashim ..... H01R 4/245 439/403
7,407,389 B2 * 8/2008 Busse ..... H01R 12/721 439/719
7,410,369 B2 * 8/2008 Busse ..... H01R 29/00 439/188
7,503,798 B2 * 3/2009 Hashim ..... H01R 4/2433 439/405
7,559,789 B2 * 7/2009 Hashim ..... H01R 4/2433 439/405
7,614,901 B1 * 11/2009 Siev ..... H01R 4/2429 439/404
7,717,732 B2 * 5/2010 Busse ..... H01R 4/2425 439/404
7,722,404 B2 * 5/2010 Neumetzler ..... H01R 12/515 439/404
7,736,173 B2 * 6/2010 Chen ..... H01R 13/41 439/395
7,753,716 B2 * 7/2010 Cox ..... H01R 4/2433 439/276
7,762,833 B2 * 7/2010 Neumetzler ..... H01R 9/2441 436/404
7,785,132 B2 * 8/2010 Muller ..... H01R 4/2429 439/402
7,828,584 B2 * 11/2010 Neumetzler ..... H01R 4/2425 439/404
7,980,883 B2 * 7/2011 Lee ..... H01R 4/242 439/404
8,016,617 B2 * 9/2011 Neumetzler ..... H01R 9/2441 439/620.08
8,025,523 B2 * 9/2011 Neumetzler ..... H01R 9/2441 439/391
8,043,110 B2 * 10/2011 Busse ..... H01R 4/2425 439/404
8,118,601 B2 * 2/2012 Busse ..... H01R 13/112 439/362
8,262,404 B2 * 9/2012 Neumetzler ..... H01R 4/2429 439/404
8,272,878 B2 * 9/2012 Neumetzler ..... H01R 13/6595 439/61
8,277,262 B2 * 10/2012 Busse ..... H01R 13/50 439/719
8,337,263 B2 * 12/2012 Freakes ..... H01F 5/04 439/396
8,747,167 B2 * 6/2014 Chen ..... F21V 19/0025 362/654
8,758,041 B2 * 6/2014 Bishop ..... H01R 12/71 439/404
2001/0022050 A1 9/2001 Bentz et al.
2003/0157827 A1 * 8/2003 Chen ..... H01R 4/2429 439/396
2008/0247112 A1 * 10/2008 Benedetto ..... H01R 13/6666 361/117
2008/0293289 A1 * 11/2008 Siev ..... H01R 4/2429 439/404
2009/0011633 A1 * 1/2009 Busse ..... H01R 4/2425 439/404
2009/0130920 A1 * 5/2009 Muller ..... H01R 4/2429 439/719
2010/0304583 A1 * 12/2010 Busse ..... H04Q 1/155 439/76.1
2010/0304600 A1 * 12/2010 Busse ..... H01R 12/727 439/404
2010/0316101 A1 * 12/2010 Sau ..... H01R 4/2429 375/222
2012/0135644 A1 * 5/2012 Muller ..... H01R 13/506 439/660
2015/0023013 A1 * 1/2015 Mochizuki ..... F21V 23/06 362/231
2015/0050829 A1 * 2/2015 Wimmer ..... H01R 4/2416 439/395
2015/0072551 A1 * 3/2015 Schmidt ..... H01R 4/2425 439/395
2015/0194742 A1 * 7/2015 Shigezane ..... H01R 13/501 439/395

FOREIGN PATENT DOCUMENTS

DE 103 52 761 A1 8/2005
DE 10 2010 044 612 A1 3/2012
FR 2 311 483 A1 5/1975
WO WO 2009/06269 A2 5/2009

* cited by examiner

Fig. 1
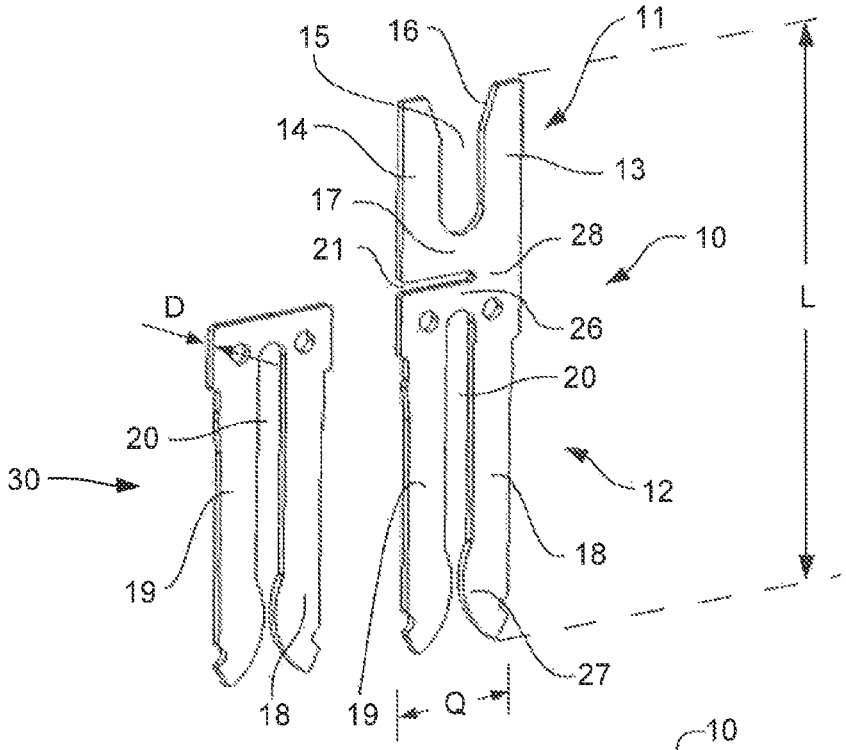
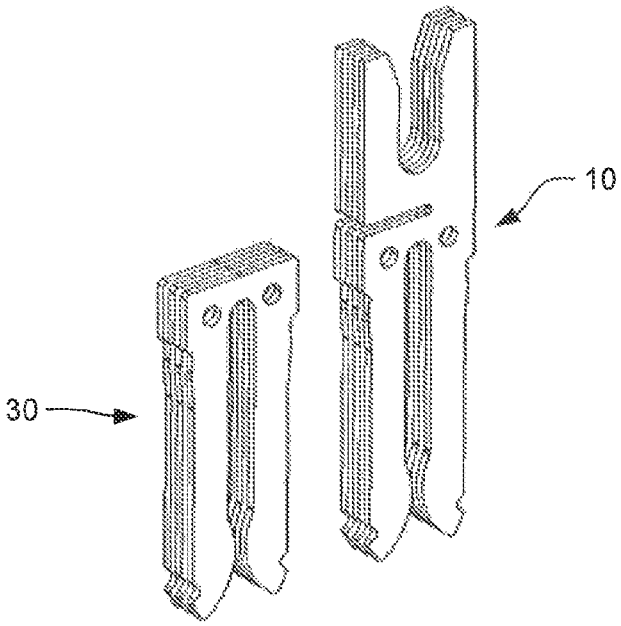
Fig. 2a
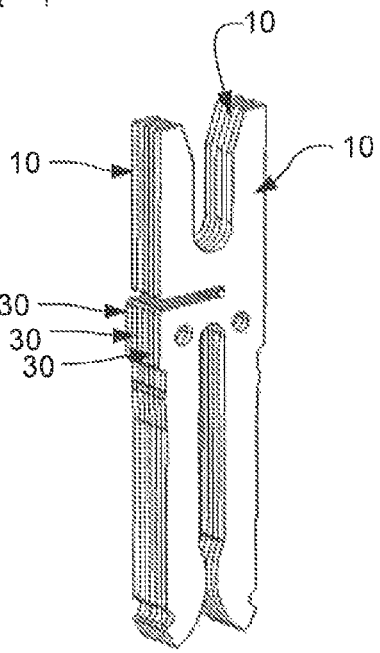
Fig. 2b

CONTACT ELEMENT

CROSS-REFERENCE TO RELATED APPLICATIONS

This application is based upon and claims the benefit of prior German Application No. 10 2013 013 458.7, filed Aug. 14, 2013, the entire contents of which are incorporated herein by reference.

TECHNICAL FIELD

The present invention relates to contact elements used to create an electrical contact between a first and a second electrical or electronic component.

The present invention relates in particular to a contact element which uses the connection method of an insulation displacement connection and of lamellae contacts for the respective electrical connection to the first and second electrical or electronic components.

BACKGROUND OF THE DISCLOSURE

Lamellae contacts are known from prior art, for example from WO 2009/062469 A2, whereas insulation displacement connections are described in a great number of embodiments, with DE 101 52 006 A1 being cited as an example. Other lamellae contacts are known from US 2001/0,022,050 A1; U.S. Pat. No. 6,866,536 B1; FR 2,311,483 A1; DE 101 49 574 A1; DE 103 52 761 A1 and DE 10 2010 044 612 A1. The lamellae contacts each have two legs that can resiliently accommodate a mating contact and have sufficiently large parallel contact areas for a good electrical contact. Such lamellae contacts are suitable for a great number of applications.

For example, U.S. Pat. No. 3,287,686 A discloses a contact element with distinctively different lamellae contacts at both ends. In this way, contact can be established on the one side with a glass substrate with applied electrical circuit and on the other side with another lamella contact that is plugged into a printed circuit board.

SUMMARY

The disclosed embodiments may include contact elements that are economical and can be produced in an automated fashion. The disclosed embodiments may facilitate a quick and automatic assembly to electrically connect two electrical and/or electronic components.

The disclosed embodiments may be based on the idea of integrating in a one-piece component, such as a stamping, an insulation displacement connection, and a contact lamellae of a lamella contact, for example. In this way, two connecting methods may be used in one component. However, to ensure the mobility of the resilient contact lamella(e) the segments in which the two connecting methods are used may have to be decoupled from one another. According to certain embodiments, this is may be implemented via a recess in the material.

Accordingly, the present disclosure proposes a contact element to create an electrical contact between a first and a second electrical or electronic component. For this purpose, the contact element may be made of an electrically conductive material and used to connect an electrically insulated cable as a first electrical or electronic component to a second electrical or electronic component, which may be contacted via a contact tab that is inserted between the contact lamellae.

The contact element may consist of a one-piece, elongated and flat body, which may have opposite end segments in a longitudinal direction. Contact to the aforementioned electrical components may occur at the respective ends of the body in longitudinal direction. In this context, the term "flat" may mean that the longitudinal and lateral dimension of the body may be substantially greater than the depth and/or thickness of the body. For example, the body may consist of a metal, such as copper or alloys thereof.

An insulation displacement connection may be provided in a first end segment of the body. An insulation displacement connection may be a connection method where the electrical conductor of a cable including its insulation is pressed into the insulation displacement connection. The "sharp" contact legs of the insulation displacement connection may sever the insulation of the cable, and a gastight electrical connection to the electrical conductor may be created, for example. This may also be referred to as an "LSA" method (solder-, screw-, and strip-free method).

A second end segment of the body may form a lamellae contact with two lamellae (also referred to as contact lamellae). The lamellae may extend in the longitudinal direction of the body. At least one of the lamellae may be provided in a resilient fashion. If both lamellae are provided in a resilient fashion, they may be developed as oppositely resilient.

For the lamella(e) to be resilient perpendicularly to the longitudinal extension of the body, and so that the integration of the insulation displacement connection does not interfere with the elasticity of the lamella(e), a recess may be provided in the material of the body between the first and second end segment. The recess may separate the two end segments and create a decoupling. This may keep the lamella and/or lamellae in one direction perpendicular to the longitudinal extension of the body in a resilient and/or elastic fashion.

In certain embodiments, the insulation displacement connection and the lamellae contact may be on a common plane and/or in a joint position. According to one embodiment, the connection between the first and second end segment may occur via a bridge of the body.

In certain embodiments, the lamella(e) of the lamellae contact may be developed resiliently in a direction parallel to the lateral extension of the body when a contact tab is inserted between the lamellae.

According to an embodiment of the present invention, the recess in the material may be introduced into the body from a side wall and/or -edge of the body. For example, an opening may be created at the side wall and/or the recess in the material may be open at the side wall. The recess in the material may run in the direction of the opposite side wall or -edge. According to one embodiment, the recess can be straight and run perpendicular to the longitudinal extension and/or parallel to the lateral direction of the body. The first and the second end segment may be decoupled from one another in lateral direction and the relative mobility of the lamellae relative to one another may remain securely fixed parallel to the lateral direction and perpendicular to the longitudinal extension.

In certain embodiments, the recess in the material may not support the insulation displacement connection over its entire lateral extension. This may lead to a deformation in the connecting area between the first and second end segment when the electrical line is pressed in. For example, torsion about the connection bridge may create deformations. To prevent this, in an embodiment, the insulation displacement connection may have a support on its side wall facing away from the connecting area. The support may bridge the recess in the material and may have a bearing surface. During assembly, the bearing surface may contact a mating surface and therefore may support the side of the insulation displacement connection. The side of the insulation displacement connection may be decoupled from lamellae contact by the recess in the material. This process may reduce the occurrences of undesired deformations.

In certain embodiments, the material of the bearing surface may be crimped over and/or folded over as a reinforcement measure. For example, double layers may be formed to provide reinforcement. In an embodiment, multiple layers can compensate for spaces in the thickness between adjacent bodies, which may result in improved stability. In certain embodiments, when the support is arranged at an angle relative to the lateral direction of the body, such as by 90°, for example, the decoupling of the lamellae contact and insulation displacement connection may be improved.

In an embodiment, the body, including the insulation displacement connection, lamellae and recess in the material, may be punched out of a flat arc of material and/or blank. When support is provided with a crimping or an angled support, an additional bending process may follow for the folding or support. This may make the body a stamping part or, in certain embodiments, a stamping and bending part.

To increase the current capacity, certain embodiments may connect a plurality of the aforementioned bodies to one another. In some embodiments, differently developed bodies, which, for example, may have only the lamellae contact (but not the insulation displacement connection), may be connected as well. For example, a body and another body may be arranged alternately, followed by a body, etc. As mentioned above, crimping may compensate for any gaps between the supports in which the body is arranged without insulation displacement connection and support. The bodies may be connected using adhesive force, frictional, and engagement connection methods.

Embodiments of the present disclosure are described in the following description. The description makes reference to the accompanying drawings.

BRIEF DESCRIPTION OF THE DRAWINGS

FIG. 1 shows a perspective view of a contact element in accordance with certain embodiments, with a body next to another body that has only a lamellae contact, but not an insulation displacement connection.

FIG. 2*a* shows a plurality of successively arranged bodies as shown in FIG. 1, next to a plurality of other successively arranged bodies as also shown in FIG. 1, in accordance with certain embodiments.

FIG. 2*b* shows a contact element including the plurality of bodies and other bodies from FIG. 2*a*, in accordance with certain embodiments.

DESCRIPTION OF THE EMBODIMENTS

Figure 3A:
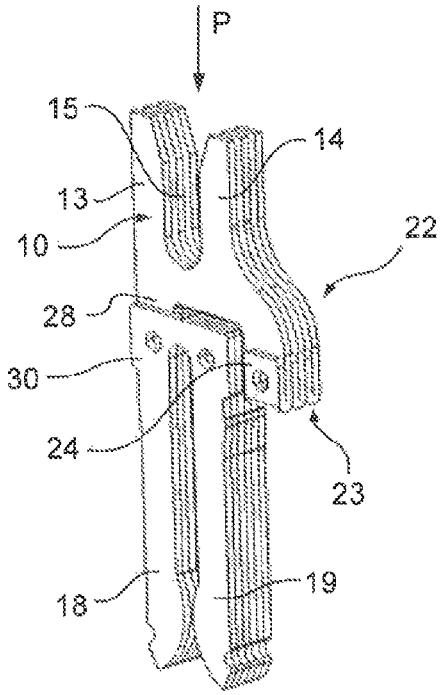
FIG. 3*a* shows a contact element of a plurality of bodies and other bodies, with the insulation displacement connection having a support, in accordance with certain embodiments.

In the following, the same reference symbols are used for the same or similar elements in the different representations. Individual embodiments and individual characteristics may be combined to form various arrangements.

FIG. 1 shows a contact element according to the present invention. The contact element may have body 10. Body 10 may be punched out of a flat material blank and/or material arc. For example, body 10 may be a metal stamping. Body 10 may be flat and elongated. It may have a longitudinal dimension L, a lateral dimension Q, and thickness D. The longitudinal dimension L may be the largest dimension, in which case body 10 is elongated, The depth and/or thickness D may be the smallest dimension, in which case body 10 is flat. Body 10 may include first end segment 11 and second end segment 12.

An insulation displacement connection may be developed in the first end segment 11. The insulation displacement connection may be U-shaped and include two opposite legs 13, 14 that form the insulation displacement connection contacts, as well as a bridge 17 that connects the legs. The insulation displacement connection may be formed by introducing a recess 15 into the flat material blank. The recess 15 may widen toward the first end of the body 10 in order to improve the connection of the electrical cable with conductor and insulation at the recess 15 between the separating clamp legs 13, 14. In an embodiment, clamp legs 13, 14 may have insertion bevels 16.

Second end segment 12 may also be substantially U-shaped. Second end segment 12 may have two contact lamellae 18, 19 that may be separated from one another by recess 20. The lamellae may form the parallel legs of the U-shape. They may be connected to one another by a bridge 26. At the second end of the body 10, the lamellae 18, 19 may have facing crowns 27 between which a contact tab can be inserted. In an embodiment, at least one of the lamellae may be resilient; for example, in FIG. 1 lamella 19 may be perpendicular to the longitudinal extension L and parallel to the lateral extension Q toward the left. However, in certain embodiments, both lamellae 18, 19 may be resilient in opposite directions parallel to the lateral direction Q.

If both bridges 17, 26 were connected directly to one another the elasticity of the lamellae 18, 19 in lateral direction Q may be compromised. Therefore, according to the certain embodiments, first end segment 11 and second end segment 12 may be separated and/or decoupled from one another by recess 21. For example, first and second end segment 11, 12 may be connected only by connection segment and/or bridge 28 which, may be smaller, such as less than half the width. This may result in lamellae 18, 19 with the bridge 26 being "axis" elastically resilient.

FIG. 1 shows other body 30 which only has the lamellae contact with the lamellae 18, 19. To increase the current capacity, other body 30 may be connected to body 10 with known connection methods.

In certain embodiments, a plurality of the bodies 10 may be connected to a plurality of the other bodies 30, as shown in FIG. 2*a*. Bodies 10 and other bodies 30 may be arranged in an alternating order, as shown in FIG. 2*b*. In an embodiment, a plurality of bodies 10 may be arranged side-by-side. In this example, recess 15, located between the separating clamp legs 13, 14 of the bodies 30, into which an insulation of the cable could be pressed during the cutting process, may be unnecessary. To reduce the counteracting force of the insulation, a partially stripped cable or fully stripped cable may be used in the contact area.

Figure 3B:
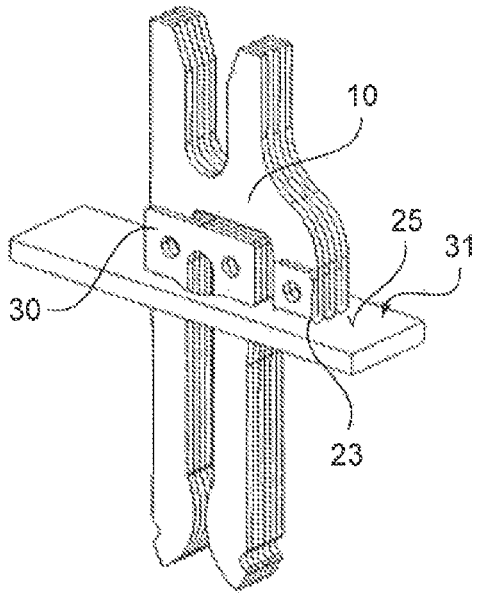
FIG. 3*b* shows the contact element in FIG. 3*a* mounted in a holder.

In an embodiment, support 23 can be provided as shown in FIGS. 3*a* and 3*b*. If an electrical cable is pressed into the recess 15 of the insulation displacement connection in direction P, there may be a risk that the first end segment 11 with the insulation displacement connection may become deformed with the connection segment 28 as point of rotation. To counteract this potential deformation, support 22 is provided. Support 22 may be an integral component of body 10 and may extend away from the insulation displacement connection at least partially parallel to the second end segment 12 in longitudinal direction L of the body 10. Support 22 may bridge the opening of the recess 21 at one side wall of the body 10. In an embodiment, support 22 may have bearing surface 23 that may run parallel to the strength and/or thickness D and to the lateral direction Q. Furthermore, support 22 may be crimped in the area of bearing surface 23 (i.e. the body 10 may be two-layered in the area).

If the contact element formed in this way, which includes a plurality of bodies 10 and a plurality of other bodies 30, is arranged in an alternating fashion and assembled in a carrier 31, the bearing surface 23 may be supported on a mating surface 25 of the carrier 31. This may support torqueing forces that may occur in the connecting segment 28 and may prevent a deformation if a cable is pressed into the insulation displacement connection.

What is claimed is:

1. A contact element for creating an electrical contact between a first and a second electrical or electronic component, comprising:

a one-piece, elongated, and flat body having:

a first end segment having a portion extending in a plane;

a second end segment opposite the first end segment;

an insulation displacement connection site in the first end segment; and a lamellae contact with two lamellae being located at the second end segment, wherein at least one lamella is resilient;

wherein the first end segment is decoupled from the second end segment by a recess in the body so that the lamellae are resilient relative to one another and perpendicular to a longitudinal extension of the body, and wherein the recess extends more than half a width of the body, and wherein the first end segment has a support extending in the plane of the first end segment, wherein the support bridges the recess in the body.

2. The contact element of claim 1, wherein at least one lamella is resilient in a direction parallel to a lateral extension of the body.

3. The contact element of claim 2, wherein the recess extends from a side wall of the body toward an opposite side wall of the body.

4. The contact element of claim 3, wherein the recess runs parallel to a lateral direction of the body.

5. The contact element of claim 4, wherein the first end segment has a bearing surface configured to bear against a mating surface.

6. The contact element of claim 1, wherein the support is crimped in an area of the bearing surface and is configured for reinforcement.

7. The contact element of claim 6, wherein the support is arranged at an angle relative to a lateral direction of the body.

8. The contact element of claim 1, wherein the body is a metal stamping.

9. The contact element of claim 1, wherein:

the recess is a first recess, and the insulation displacement connection site includes a first leg separated from a second leg by a second recess.

10. The contact element of claim 9, wherein the second recess widens in a lateral direction of the body as the second recess extends in the longitudinal extension of the body.

11. A contact element arrangement, comprising:

at least one first contact element, comprising:

a one-piece, elongated, and flat body having:

a first end segment;

a second end segment opposite the first end segment;

an insulation displacement connection site in the first end segment; and a lamellae contact with two lamellae being located at the second end segment, wherein at least one lamella is resilient;

wherein the first end segment is decoupled from the second end segment by a recess in the body so that the lamellae are resilient relative to one another and perpendicular to a longitudinal extension of the body; and at least one second contact element having a body different from the body of the at least one first contact element and including a lamella contact lacking an insulation displacement connection;

wherein the body of the at least one first contact element is connected with the body of the at least one second contact element.

12. The contact element arrangement of claim 11, wherein at least one lamella is resilient in a direction parallel to a lateral extension of the body of the at least one first contact element.

13. The contact element arrangement of claim 12, wherein the recess extends from a side wall of the body of the at least one first contact element toward an opposite side wall of the body of the at least one first contact element.

14. The contact element arrangement of claim 13, wherein the recess runs parallel to a lateral direction of the body of the at least one first contact element.

15. The contact element arrangement of claim 14, wherein the first end segment has a support that bridges the recess in the body of the at least one first contact element and a bearing surface configured to bear against a mating surface.

16. The contact element arrangement of claim 15, wherein the support is crimped in an area of the bearing surface and is configured for reinforcement.

17. The contact element arrangement of claim 16, wherein the support is arranged at an angle relative to a lateral direction of the body of the at least one first contact element.

18. The contact element arrangement of claim 11, wherein the body of the at least one first contact element is a metal stamping.

19. The contact element arrangement of claim 11, wherein:

the recess in the body of the at least one first contact element is a first recess, and the insulation displacement connection site includes a first leg separated from a second leg by a second recess.

20. The contact element arrangement of claim 19, wherein the second recess widens in a lateral direction of the body of the at least one first contact element as the second recess extends in the longitudinal extension of the body of the at least one first contact element.

* * * * *